United States Patent [19]

Tough

[11] Patent Number: 4,727,731

[45] Date of Patent: Mar. 1, 1988

[54] COMPOSITE SHEET MATERIAL

[75] Inventor: William H. Tough, Tayport, Scotland

[73] Assignee: Scott & Fyfe Limited, Scotland

[21] Appl. No.: 922,457

[22] Filed: Oct. 23, 1986

[30] Foreign Application Priority Data

| | | | |
|---|---|---|---|
| Oct. 25, 1985 | [GB] | United Kingdom | 8526342 |
| Apr. 8, 1986 | [GB] | United Kingdom | 8608493 |
| Jun. 19, 1986 | [GB] | United Kingdom | 8614964 |

[51] Int. Cl.[4] ..... D04B 23/06

[52] U.S. Cl. ..... 66/85 A; 66/190; 66/192; 66/193

[58] Field of Search ..... 66/190, 193, 191, 196, 66/192, 84 A, 85 A

[56] References Cited

U.S. PATENT DOCUMENTS

| | | | |
|---|---|---|---|
| 1,501,875 | 7/1924 | List | 66/85 |
| 3,104,633 | 8/1960 | Newman | 112/2 |
| 3,230,744 | 1/1966 | Carbonaro | 66/85 A |
| 3,538,527 | 11/1970 | Ioannilli | 12/142 |

FOREIGN PATENT DOCUMENTS

| | | |
|---|---|---|
| 3305348 | 2/1983 | Fed. Rep. of Germany . |
| 357650 | 9/1903 | France . |
| 21939 | of 1905 | United Kingdom . |
| 927711 | 6/1963 | United Kingdom . |
| 1422940 | 1/1976 | United Kingdom . |
| 2005318A | 4/1979 | United Kingdom . |
| 2103671A | 2/1983 | United Kingdom . |

*Primary Examiner*—Ronald Feldbaum
*Attorney, Agent, or Firm*—Bacon & Thomas

[57] ABSTRACT

In a method of producing composite sheet material by forming longitudinal rows of stitches 7 in a paper sheet material 1, the length of paper sheet material 1 used per stitch 7 is increased so that there is entrapped within each stitch 7 in each longitudinal row of stitches 7 a portion of paper sheet material 1 having a length greater than the length of the completed stitch 7. In consequence there are formed in the composite sheet material a longitudinal series of laterally extending corrugations, ridges or ribs which, in the case of a crepe paper sheet material 22, constitute a gross crimp imposed without distortion of the crimps in the initial crepe paper sheet material 22.

The increase in the length of the sheet material used per stitch may be effected by the action of the needles 9 of the stitching machine to withdraw a greater quantity of sheet material 1 or 22 from a feed roll or the increase in the length may be effected by positively overfeeding the sheet material 1 or 22 to provide slack sheet material which is entrapped within the stitches 7 as a result of the needle action.

The method of the invention may be used when producing composite sheet material by stitching through a plurality of sheets 23, 25 or 27, 28, 30 of sheet material. When there are a plurality of sheet materials the increase in length may be confined to only one or some of the sheet materials or may be provided in all the sheet materials.

The paper sheet material may be either plain paper or crepe paper or when a plurality of sheet materials are used a pair of either plain or crepe or any combination thereof.

24 Claims, 13 Drawing Figures

COMPOSITE SHEET MATERIAL

BACKGROUND OF THE INVENTION

This invention relates to composite sheet material and more particularly to a composite sheet material comprising rows of stitches formed in a base sheet.

The present Applicants previously developed a composite sheet material which is a stitched crepe paper and the manufacture of which is described and claimed in U.K. Pat. No. 1,422,940. This stitched crepe paper product has properties which make it particularly suitable as a backing for a carpet underlay, the product having dimensional stability and being capable of adhesion to a sheet of foamed or sponge rubber.

The present Applicants have now developed an improved method of making a composite sheet material having longitudinal rows of stitches to provide dimensional stability, but the method of the present invention enables the product to be stronger and thicker than the product of U.K. Pat. No. 1,422,940, and to have greater depth in the gaps between the stitches thus making the product more suitable for adhering to materials other than rubber materials, for example synthetic resin materials in any suitable form.

BRIEF SUMMARY OF THE INVENTION

According to the present invention there is provided a method of producing composite sheet material by forming longitudinal rows of stitches in a sheet material, in which the length of sheet material used per stitch is increased such that, when the stitches are formed, there is entrapped, within each stitch in each longitudinal row of stitches formed in the sheet material, a portion of sheet material having a length greater than the length of the completed stitch.

As a result of entrapping within each stitch a portion of sheet material having a length greater than the length of the completed stitch there is formed a stitched corrugated product having laterally extending corrugations, ridges or ribs according to the additional amount of sheet material gathered within each stitch. These corrugations, ridges or ribs cause there to be a greater depth in the gaps between the stitches than in the stitched crepe paper product of U.K. Pat. No. 1,422,940. The product of the present invention is therefore more suitable for adhering to other materials, for example in forming laminates. Also the product has greater lateral flexural rigidity than the known stitched crepe paper product.

The method of the present invention has particular application in the manufacture of composite sheet materials from paper sheet material but it is not limited to the use of paper. A method in accordance with the present invention may be used to produce composite sheet materials from other flexible sheet materials than paper, for example plastics film may be employed.

A method in accordance with the present invention enables the composite sheet material to be forced from a base sheet material which is either plain or creped. In addition the composite sheet material may be formed from a plurality of sheets of base sheet material fed simultaneously to a stitching machine which stitches through all the plurality of sheets to stitch them together. Thus varying degrees of bulk may be obtained in the resulting product, increasing from the case when the base sheet material is a plain sheet material through the case where crepe sheet material is used to the still greater bulk which is obtained using two or more sheets of the base sheet material.

The increase in the length or lengths of base sheet material used per stitch in the method of the present invention may be effected by the needles, which are used to form the rows of stitches, themselves moving the sheet material or materials without piercing thereof to withdraw the increased length of sheet material or sheet materials from a supply roll or rolls. In such case the needles employed are preferably round-headed needles.

Alternatively, the increase in the length or lengths of sheet material used per stitch may be effected by advancing sheet materials to the needles, which are used to form the rows of stitches, at a rate faster than the rate required to match the rate of stitching. Slack sheet material, which is thereby provided in the region of the needles, is moved by the needles through a predetermined distance without piercing the sheet material, the needles thereafter piercing the sheet material and forming the stitches.

The method of the present invention provides another very important advantage as compared with the method of U.K. Pat. No. 1,422,940. When a plain paper sheet material is used in the method of the present invention, a composite sheet material having enhanced properties as compared with the product of U.K. Pat. No. 1,422,940 is produced in a single stage of treatment as compared with the two stages of treatment to a sheet of plain paper required when following the method of U.K. Pat. No. 1,422,940, that is to say, first, a creping of the plain paper, and, secondly, the reinforcing of the plain paper by the longitudinal rows of stitches.

In addition by the method of the present invention the Applicants have produced a method of forming rows of stitches in a plain paper. It had previously been thought that it was necessary to use crepe paper sheet material, which has an ability to stretch longitudinally, in order to enable successful needling of the paper to be accomplished without tearing the paper or damaging the stitch bonding machine.

When a crepe sheet material is used as a base sheet material it is surprisingly found that the length of sheet material used per stitch may be increased using round-headed needles to increase the length of sheet material used per stitch. It is surprising that the action of the needles on, for example, a crepe paper sheet material results in a withdrawal of a greater length of crepe paper sheet material from the feed roll rather than an opening of the crimps in the crepe paper.

In accordance with this aspect of the present invention a bulkier product with increased lateral flexural rigidity as compared with the use of plain paper sheet material is obtained as a result of the superimposition of corrugations, ridges or ribs upon a sheet material which is already creped.

When a plurality of sheets of sheet material is employed, the lengths of all the sheet materials used per stitch may be increased, in which case laterally extending corrugations, ridges or ribs are formed in all the sheet materials. Alternatively, however, the increase in length may be provided in some only of the sheet materials in which case there is formed a composite product having, for example, a flat sheet material on one surface and a corrugated sheet material on the other surface. The corrugated sheet material in this product may be formed by increasing the length of sheet material used by either of the methods described, that is to say either by the action of the needles on the base sheet material or by the act of feeding sheet material to the stitch bonding machine faster than the material is being stitched, and thus creating a quantity of slack sheet material in the stiching machine.

In accordance with this aspect of the present invention it is envisaged that the composite sheet material may comprise three layers of, for example, paper sheet material, an increase in the length of sheet material entrapped within each stitch being provided for the two outer sheets of sheet material but not for the central sheet of the three. Preferably, in such a case, the increase in length of the two outer sheets is provided by overfeeding these sheet materials, and the central sheet is advantageously a crepe paper sheet material.

Usually only two sheets of sheet material will be employed to form a product having stitches through the plurality of sheet materials. It is envisaged that, however many sheets are employed, the sheet materials may be any combination of plain and crepe sheet materials. When two sheets are used, both sheets may be plain paper sheet materials, both may be crepe paper sheet materials, or there may be one plain paper sheet material and one crepe paper sheet material. In this last case, either the plain paper sheet material or the crepe paper sheet material may be first pierced by the needles.

The products obtained by the methods of the present invention may include weft threads in order to increase further the transverse tensile strength, and hence the longitudinal tear strength, of the resultant product. Such weft threads are retained in the composite sheet material by the stitching. When the product comprises a plurality of sheet materials the weft threads may be applied to the outside surface of one or other of the sheet materials, but the weft threads are preferably laid between the two sheet materials before these are brought together for stitching so that the weft threads in the final product are concealed.

There are two types of stitching machine which include provision for laying weft threads. In one type of stitching machine the weft threads are laid at right-angles to the direction of advancement of the sheet material, which is also the direction of the stitching. In the other type of machine the weft threads are laid obliquely to the direction of advancement. Either type of machine may be used in accordance with the present invention to lay the weft threads which are concealed between the two sheets of sheet material. When the weft threads are concealed in this manner, the appearance of the ultimate product is not affected by the choice of the type of stitching machine, but the appearance will be affected when the weft threads are laid on an outside surface of one of the sheet materials.

In the other embodiments of the present invention the weft threads must be present on an exposed surface of the composite sheet material. However, the weft threads can be largely obscured if the composite sheet material is made using the type of stitching machine in which the weft threads are laid at right-angles to the direction of stitching. In such cases a weft thread may be laid for each stitch, and an upstanding hump or ridge of the sheet material, which is caused to lean at an angle to the general plane of the composite sheet material by the stitching yarn, will at least partially obscure the weft thread.

If the other type of stitching machine, of which the Malimo stitch bonding machine is an example, is employed, the weft threads will inevitably cross the corrugations, ridges or ribs in the composite sheet material.

According to a further aspect of the present invention there is provided a composite sheet material comprising a sheet material having a longitudinal series of laterally extending tubular ribs formed therein, the ribs being maintained in tubular form in the sheet material by a series of side-by-side longitudinally extending rows of stitches formed in the sheet material.

According to a still further aspect of the present invention there is provided a composite sheet material comprising a sheet of crepe paper having a gross crimp imposed thereon without distortion of the crimps in the initial crepe paper, the gross crimp being maintained by a series of side-by-side longitudinally extending rows of stitches.

According to a yet further aspect of the present invention there is provided a composite sheet material comprising a plurality of sheets of sheet material having a longitudinal series of laterally extending corrugations, ridges or ribs formed in at least one of the sheets of sheet material, the ribs being maintained in the said sheet or sheets of sheet material by a series of side-by-side longitudinally extending rows of stitches extending through the plurality of sheets of sheet material.

BRIEF DESCRIPTION OF THE DRAWINGS

The present invention will be further understood from the following detailed description of a method and products in accordance therewith which is made, by way of example, with reference to the accompanying schematic drawings, in which.

DETAILED DESCRIPTION

Figure 2:
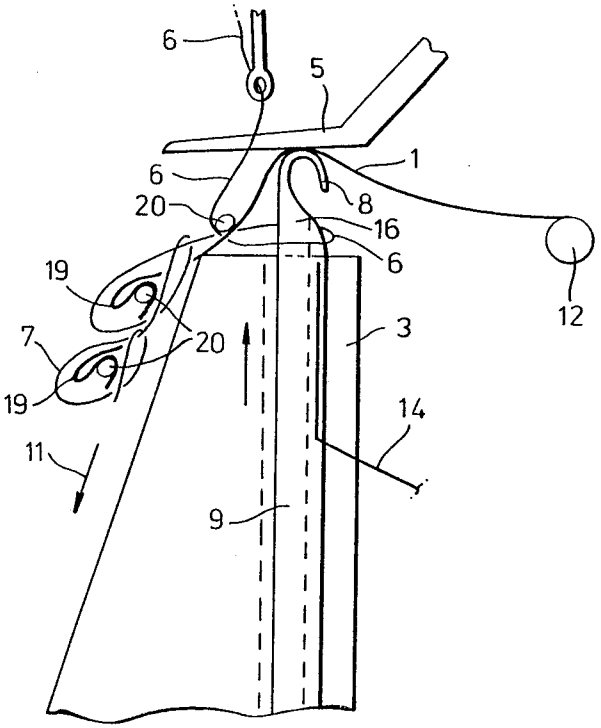
FIGS. 1 to 5 show one set of the main functional elements of a stitch-bonding machine in positions adopted successively during the formation of a single stitch.

In the drawings the same or similar parts are designated by like reference numerals.

Figure 6:
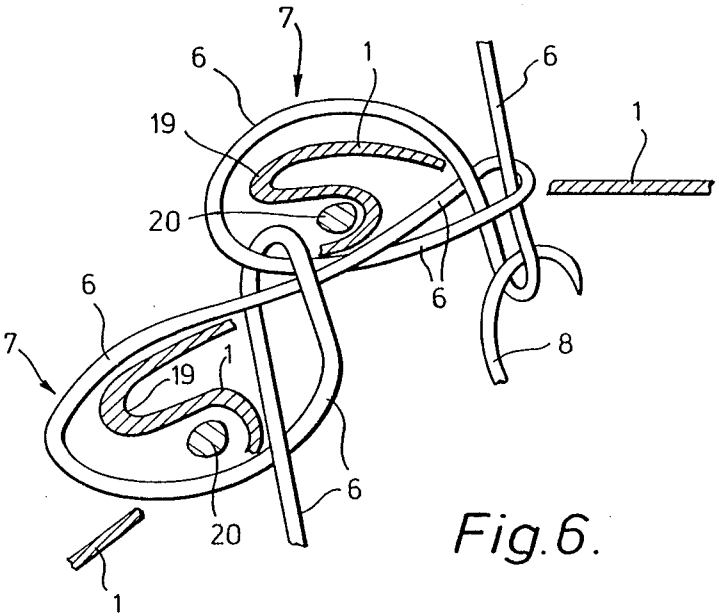
FIG. 6 is a cross-sectional view on a greatly enlarged scale of a portion of a composite sheet material of the present invention encompassed by two stitches in a plain paper sheet material.

In the diagrammatic representations of FIGS. 1 to 5 and the enlarged cross-sectional view of FIG. 6 the hole in the paper through which stitching yarn passes is shown as a gap in the paper sheet material.

FIGS. 1 to 5 of the drawings each show a single needle and stitching, but it will be appreciated that the machine contains a row of similar needles extending over the full width of the sheet material and performing the same movements simultaneously.

Figure 1:
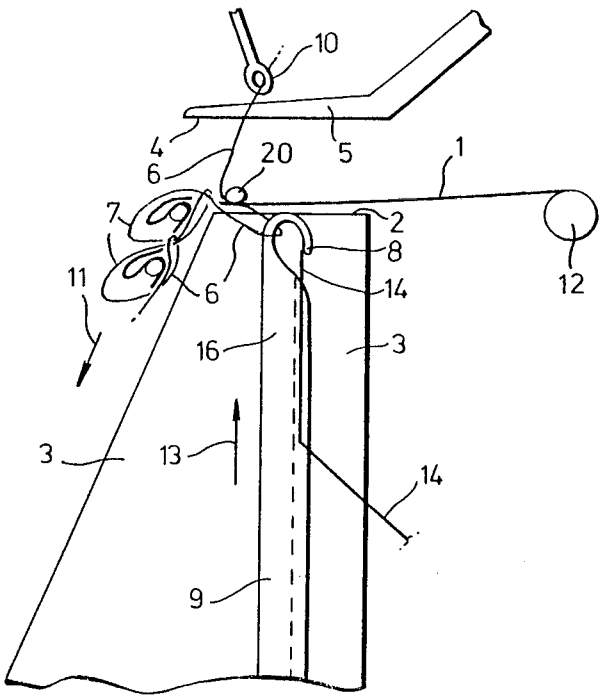

Referring to FIG. 1 there is shown a sheet 1 of plain paper which is passing between an outer surface 2 of a knock-over bar 3 and a restraining surface 4 formed by a series of fingers comprising a sinker unit 5. A stitching yarn 6, which has already formed stitches 7 in the sheet 1 of plain paper passes over a hook 8 of a round-headed stitching needle 9, and thence through the sheet 1 of plain paper and through an eyelet 10 which guides the feed of the stitching yarn 6.

The arrow 11 in FIG. 1 indicates the action of take-off rollers (not shown) in drawing the sheet 1 through the stitch-bonding machine. The sheet 1 is supplied on a feed-roller 12 from which it is drawn as a result of the tractive forces applied by the takeoff rollers and the stitching needles, as will be described.

In the position shown in FIG. 1, the needle 9 is advancing in the direction of the arrow 13 to pass the upper surface 2 of the knock-over bar 3 towards the fingers of the sinker unit 5 with a loop of stitching yarn 6 placed in the hook 8 of the needle 9 during the previous stroke. The needle hook 8 is closed by a closing wire 14.

The advance of the round-headed needle 9 in the direction of the arrow 13 causes the needle 9 to lift the sheet 1 rather than to pierce the sheet 1, thereby causing more of the sheet 1 to be withdrawn from the feed roller 12.

Referring now to FIG. 2 the needle 9 has advanced almost to the point of contact with the sinker unit 5, lifting the sheet 1 of plain paper while doing so. During this movement the closing wire 14 is retracted to open the needle hook 8 and allow the stitching yarn 6 to exit from the hook 8 as the needle 9 rises. This yarn now lies around the shank portion 16 of the needle 9. At the position shown in FIG. 2 the extra length of the sheet 1 withdrawn from the feed roller 12 is shown draped over the round head of the needle 9, in the form of an upstanding ridge in the sheet 1, which extends across the width of the sheet 1 under the action of the other needles in the row.

Figure 3:
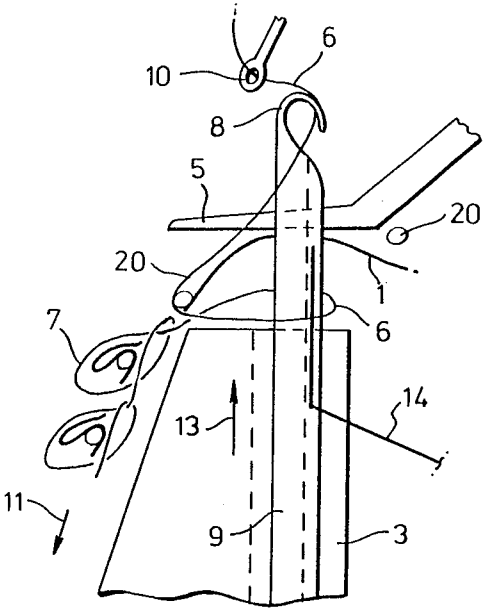

Referring to FIG. 3, the needle 9 has advanced through the fingers of the sinker unit 5 which has restrained the sheet 1 of plain paper with the result that the needle 9 has penetrated the sheet 1. In FIG. 3 the needle 9 is shown at the top of its stroke and, with its hook 8 open, the needle 9 has received a further loop of yarn 6 fed as a result of the shogging action of the eyelet 10.

Figure 4:
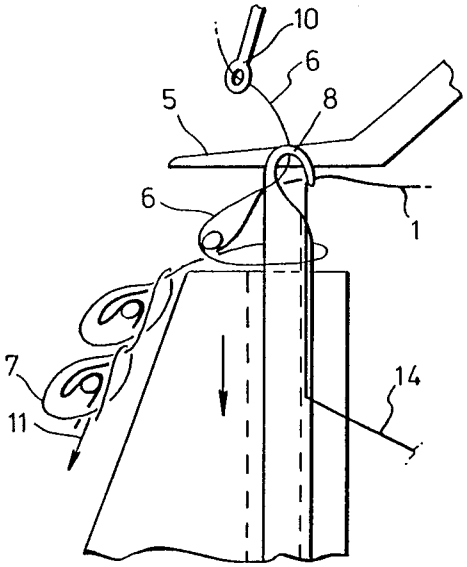

In FIG. 4 the needle 9 is shown during the first part of the return stroke when the closing wire 14 has advanced to close the hook 8. The stitching yarn 6 is thus withdrawn through the sheet 1 of plain paper by the needle 9, entrapping within the stitch which is in the process of being formed, a length of the sheet 1 greater than the length of the stitch, as a result of the sheet 1 having been lifted as described with reference to FIG. 2 to form a ridge in the sheet.

Figure 5:
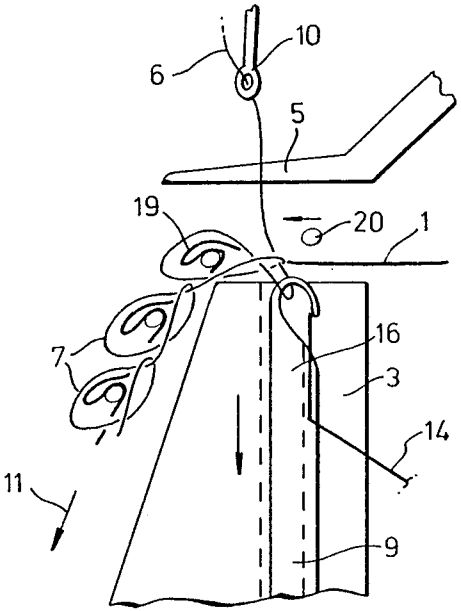

In FIG. 5 the needle 9 with its hook 8 closed has been withdrawn below the sheet 1 of plain paper which is now retained by the upper surface 2 of the knock-over bar 3, which also ensures that the loop of stitch yarn 6 previously lying around the shank 16 of the needle 9 passes over the close.d hook and round the yarn now trapped in the hook 8. The stitch thus formed is pulled tight by the forward draw-off motion of the take-off rollers.

In pulling tight, the upstanding ridge in the sheet 1 is trapped within the stitch and is forced to form a roll or crinkle lying across the finished material within each lateral row of longitudinal stitches 7. This roll or crinkle, as may readily be seen from the accompanying drawings and more particularly from FIG. 6, is deformed by the stitch 7 in a forward direction, i.e. in the direction of travel of the sheet 1 through the stitch bonding machine.

The roll or crinkle 19 (FIG. 6) formed across the width of the sheet 1 by the stitching action in accordance with the present invention constitutes a tubular rib extending across the width of the composite sheet material formed in accordance with the present invention, giving the final stitched paper product effectively a greater thickness and a greater lateral flexural rigidity, i.e. a greater resistance to lateral bending, than the stitched crepe paper product according to U.K. Pat. No. 1,422,940 when paper of comparable weight is used in both methods. In consequence it is not essential to include laid weft yarns in a product of the present invention, as is described in the said earlier patent. However, if such weft yarns 20 are laid, the deformed rolls or crinkles in the sheet 1 of plain paper will substantially cover the laid weft yarns from view in the normal case where there is a single weft yarn 20 for each stitch and the weft yarn 20 is laid at right angles to the direction of stitching.

It has been found that a satisfactory stitched paper product may be obtained by the method described with reference to the accompanying drawings when the spacing between the outer surface 2 of the knock-over bar 3 and the surface 4 constituted by the fingers of the sinker unit 5 is of the order of 4 to 5 mm. A gap of this dimension enables an upstanding ridge to be formed in the paper and contrasts with the arrangement employed in manufacturing the product of U.K. Pat. No. 1,422,940 in which the gap between the knock-over bar and the sinker unit is just sufficient comfortably to pass the crimped or creped paper and the weft yarns laid thereon. The gap normally employed for this purpose is of the order of 1.5 mm.

In the successful practice of the method of the present invention a plain paper of weight of approximately 40 grammes per square metre was employed and the stitch-bonding machine was run at a speed of 400 stitches per minute. The tractive force on the paper was provided by the take-off rollers and the stitching action as described. It is envisaged that the machine can be run at higher speeds approaching the speed of 1000 stitches per minute used in the performance of the method of U.K. Pat. No. 1,422,940, but it may then be desirable, in order to avoid premature penetration of the paper by the needle, to include on the feed roller 12 a tension release device which can probably be a suitable gear drive or a slipping clutch.

The product in accordance with this embodiment of the present invention formed with a suitably extensible stitching yarn, e.g. a polypropylene yarn, may be hot-stretched to almost twice its original length with a resultant flattening of the tubular rolls or crinkles constituting the laterally extending ribs in the composite sheet material. Although paper has been described as the sheet material, it is envisaged that other flexible materials, for example plastics film, may be employed.

The composite sheet material prepared from plain paper sheet material by the method of the present invention as hereinbefore described is a more rugged material than the stitched crepe paper product of U.K. Pat. No. 1,422,940. This product is thicker, and has greater depth in the gaps between the stitches thus making the product more suitable for adhering to other materials in forming laminates since better anchor points of adhesive can be formed. In addition this product has, as already noted, greater lateral flexural rigidity.

One example of a composite sheet material made by the method of the present invention using a crepe paper sheet material will now be described with reference to FIG. 7 of the accompanying drawings. A preferred method of making this product using the crepe paper base sheet material is identical with the method described hereinbefore with reference to FIGS. 1 to 5 in relation to a plain paper sheet material.

Figure 7:
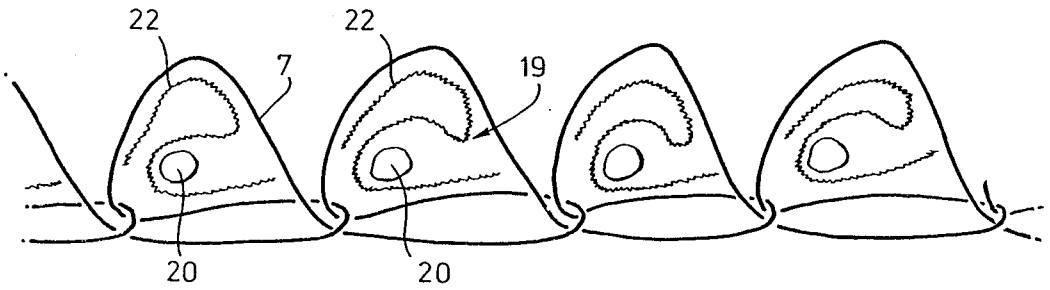
FIG. 7 is a diagrammatic representation of a portion of a composite sheet material of the present invention encompassed by four stitches in a crepe paper sheet material.

In FIG. 7 of the accompanying drawings the crepe paper is denoted by the reference numeral 22 and a greater length of the crepe paper 22 than the length of a stitch 7 is contained within each stitch 7. A weft thread 20 is substantially covered and is largely obscured from view by the deformed roll or crinkle 19 in the crepe paper within each stitch.

In FIG. 7 a break is shown in the crepe paper 22 in order to represent the hole formed in the crepe paper by the action of the needle in forming the stitch 7 through the crepe paper 22.

Good results have been obtained using crepe papers formed by reducing the lengths of plain paper, for example of 40 grammes weight per square metre, by about 50% and about 75%.

The product of FIG. 7 has a substantially increased thickness as compared with the product of U.K. Pat. No. 1,422,940 and is very much bulkier due to the longer lengths of the crepe paper which are trapped in the stitched loops giving a clear ridge effect running transversely and distinguishing the product visually from the product of U.K. Pat. No. 1,422,940.

As a result of the greater surface area of crepe paper trapped per stitch, the product of FIG. 7 has a potential for increased adhesion properties as compared with the product of both U.K. Pat. No. 1,422,940 and the product of FIG. 6. The product of FIG. 7 also has an enhanced ability to be stretched longitudinally after stitching. It is found that whereas a product of U.K. Pat. No. 1,422,940 may be stretched only to about 1.4 times its original length before the paper component tears, and the product of FIG. 6 may be stretched to about twice its original length, the product of FIG. 7 may be stretched to about 2.2 times its original length. This additional stretching ability is due to the presence in the product of both the initial paper crimp and the gross crimp resulting from the method of the present invention.

The freedom to apply higher stretch enables the production of a final product of enhanced longitudinal dimensional stability.

The product of FIG. 7, either as formed in the method of the present invention, or with additional subsequent stretching, may be employed, for example, as a carpet underlay base fabric, a secondary carpet backing, a wall covering, or as a table covering.

In the method of FIGS. 1 to 5 and the product of FIGS. 6 and 7 the weft threads are shown as having been laid on top of the paper sheet material. Equally, however, the weft threads may be laid first in the stitch bonding machine and the paper sheet material fed in from the top of the machine to lie over the weft threads which may then be secured to the stitching material in the manner described with reference to FIGS. 1 to 5 but with the paper sheet material above the weft threads.

As one alternative to the method described with reference to FIGS. 1 to 5, means may be provided for overfeeding the sheet material, for example either plain paper or crepe paper, by advancing it at a rate such as to create a quantity of slack sheet material which is moved by the needles without the needles piercing the sheet. The needles may then be of any profile, for example sharply pointed. When the movement of the sheet material by the needles is restrained, the needles pierce the sheet material and form the stitch through the sheet material thereby entrapping within each stitch in each longitudinal row of stitches formed in the sheet material, a portion of sheet material having a length greater than the length of the completed stitch.

As another alternative method, instead of positively overfeeding the sheet material in order to create a quantity of slack sheet material in the region of the needles, the feed roll may be free of any braking or other restraining mechanism so that slack sheet material is readily made available by the action of needles of any profile without piercing of the sheet material.

Any of the methods described may be employed in the manufacture of a composite sheet material in accordance with the present invention by stitching together two or more sheets of sheet material. Some examples of composite sheet materials including two or more sheets of sheet material will now be described with reference to FIGS. 8 to 13 of the accompanying drawings.

Figure 8:
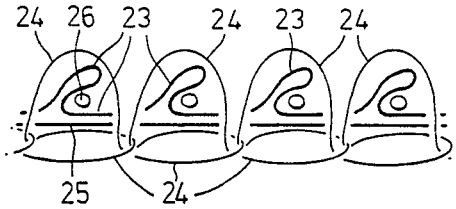
FIGS. 8 to 11 are diagrammatic representations of portions of composite sheet materials of the present invention each including two sheets of a paper sheet material.

In FIG. 8 there is shown a portion of a composite sheet material including two sheets of paper sheet material which may be either both plain or both crepe or any combination of plain and crepe paper sheet materials. An increase in the length of the upper paper sheet material 23 entrapped within each stitch 24 has been created by a method in accordance with the present invention while the lower paper sheet material 25 has been retained under tension so that there is no increase in the length of the lower paper sheet material 25 entrapped within each stitch 24. The composite sheet material illustrated in FIG. 8 is made using sharply pointed needles to pierce the lower paper sheet material 25 while the upper paper sheet material 23 is either positively overfed or is provided from a freely rotatable feed roll so that the sharply pointed needles will raise the upper paper sheet material 23 until this upward movement by the needles is restrained by the sinker unit when the needles will pierce the upper paper sheet material 23 and thereafter form the stitch 24 which entraps the increased length of the upper paper sheet material 23 above the weft yarn 26 which has been laid on the surface of the upper paper sheet material 23.

Figure 9:
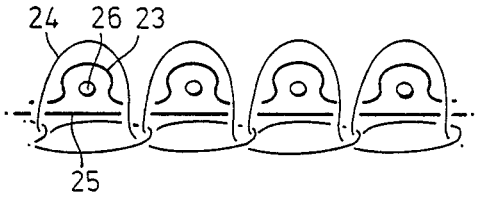

FIG. 9 shows another embodiment of composite sheet material which differs from the product of FIG. 8 in that the weft yarns 26 are laid on the lower paper sheet material 25 and the upper paper sheet material 23 is fed into the stitching machine from the top so that the upper paper sheet material 23 lies over the weft yarns 26 which are concealed between the two paper sheet materials.

Figure 10:
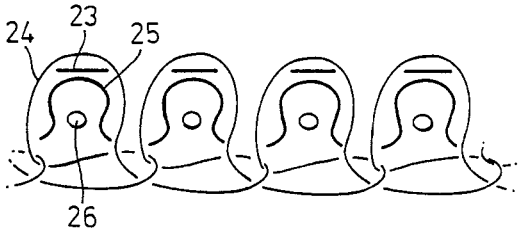

In the embodiment of FIG. 10 a composite sheet material including two sheets of paper sheet material has an increased length of the lower paper sheet material 25 entrapped within each stitch 24, while there is no increase in the length of the upper paper sheet material 23 entrapped within each stitch 24. Also the weft threads 26 are held by the stitches 24 underneath the lower paper sheet material 25.

The product of FIG. 10 is made by feeding both paper sheet materials 23 and 25 in from the top of the machine over the laid weft threads 26. The upper paper sheet material 23 is tensioned so as to be sited against the sinker unit while the bottom sheet material is advantageously overfed or supplied from a freely rotatable feed roll. The needles used may have any profile, either round-headed or sharply pointed, although it may be preferred to use sharply pointed needles if the paper sheet materials are not very readily penetrable.

Figure 11:
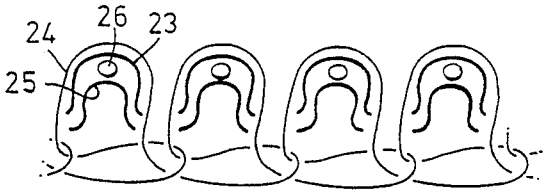

In FIG. 11 there is illustrated a composite sheet material including two paper sheet materials in which there is an increase in the lengths of both paper sheet materials entrapped within the stitch 24. In this embodiment the weft threads 26 are located between the two sheets of sheet material 23 and 25. Advantageously, both paper sheet materials are overfed or provided from freely rotatable feed rollers. Although the two paper sheet materials may have the lengths entrapped within the stitches 24 increased by the action of round-headed needles withdrawing paper from both feed rollers this is not the preferred arrangement because of the extra power required to cause the round-headed needles to penetrate the two paper sheet materials when these are restrained from further movement by the sinker unit.

Figure 12:
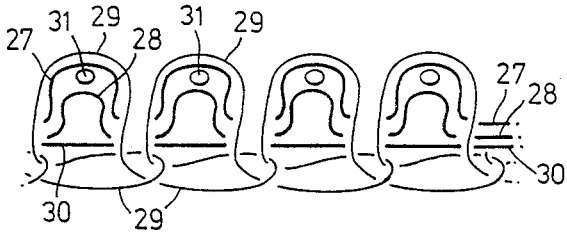
FIGS. 12 and 13 are diagrammatic representations of portions of composite sheet materials of the present invention each including three sheets of a paper sheet material.
Figure 13:
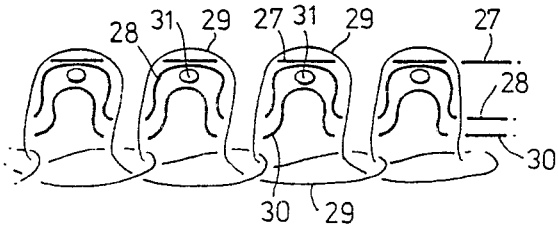

FIGS. 12 and 13 show representations of composite sheet materials including three sheets of paper sheet material. In the embodiment of FIG. 12 increased lengths of the top and middle paper sheet materials 27 and 28 are entrapped within each stitch 29 while there is no increase in the length of the bottom sheet material 30 entrapped within each stitch 29. In manufacture of the product of FIG. 12, sheet materials 28 and 30 are fed into the stitch bonding machine one above the other for advancing in the usual way to the stitching zone. Weft threads 31 are laid on the upper surface of the sheet material 28 during this advance, and sheet material 27 is fed in from the top of the machine. Sheet material 30 is fed under tension while sheet materials 28 and 27 are overfed or fed without tension. Sharply pointed needles pierce the sheet material 30 and then raise sheet materials 28 and 27 until these are restrained by the sinker unit to increase the lengths of sheet materials 28 and 27 entrapped within each stitch 29 formed after piercing of the sheet materials 28 and 27 as a result of the restraint by the sinker unit.

In the embodiment of FIG. 13 increased lengths of the middle and lowermost sheet materials 28 and 30 are entrapped within each stitch 29 while there is no increase in the length of the uppermost sheet material 27 entrapped within the stitch 29. Weft threads 31 are laid on a non-tensioned or overfed sheet material 30, and sheet materials 27 and 28 are fed in from the top of the machine, sheet material 27 under tension against the sinker unit, and sheet material 28 overfed. The action of the needles moves the sheet materials 30 and 28 to ensure that increased lengths of each of these materials is entrapped within each stitch 29.

Although all the embodiments of FIGS. 8 to 13 have been shown as including weft yarns, these weft yarns may be omitted. The products of FIGS. 8 to 13 are very rugged materials with greater thickness than the products of FIGS. 6 and 7 and very good lateral flexural rigidity even in the absence of weft yarns.

Also the products of FIGS. 8 to 13 may be made from sheet materials other than paper sheet materials, for example sheets of plastics film may be employed.

The products of FIGS. 8 to 13 may also be subjected to hot-stretching, as a result of which a product with excellent dimensional stability is produced with a greater economy in the quantity of sheet material used than occurs in the manufacture of the un-stretched products of FIGS. 8 to 13.

I claim:

1. A method of producing composite sheet material in which longitudinal rows of stitches are formed in a sheet materal by needles which are advanced and retracted during the formation of each stitch, the method comprising the steps of utilizing the needles in a first stage of the advance thereof to move the sheet material without piercing the sheet material thereby increasing the length of sheet material used per stitch, subsequently restraining the sheet material from further movement by the needles thereby causing the needles in a second stage of the advance thereof to pierce the sheet material, and thereafter retracting the needles to form the stitch and thereby entrap within each stitch in each longitudinal row of stitches formed in the sheet material a portion of sheet material having a length greater than the length of the completed stitch.

2. A method according to claim 1, in which the longitudinal rows of stitches are formed through a plurality of sheets of sheet material fed simultaneously to a stitching machine, and the lengths of all sheet materials used per stitch are increased such that lengths of all sheet materials greater than the length of the completed stitch are entrapped within each stitch.

3. A method according to claim 1, in which the longitudinal rows of stitches are formed through a plurality of sheets of sheet material fed simultaneously to a stitching machine, and the length of sheet material used per stitch is increased for one of the sheet materials only.

4. A method according to claim 1, in which the sheet material is a plain paper sheet material.

5. A method according to claim 1, wherein the sheet material is a crepepaper sheet material.

6. A method according to claim 1, wherein the rows of stitches are formed through two sheets of different sheet materials, one sheet material being a plain paper sheet material and the other being a crepe paper sheet material.

7. A method according to claim 1, wherein the rows of stitches are formed through two sheets of plain paper sheet material.

8. A method according to claim 1, wherein the rows of stitches are formed through two sheets of crepe paper sheet material.

9. A method according to claim 1, wherein the rows of stitches are formed through two sheets of sheet material and wherein weft threads are laid between the sheets of sheet material prior to stitching by the stitching machine.

10. A method according to claim 1, in which the portion of sheet material entrapped within each stitch forms a tubular rib extending across the width of the composite sheet material.

11. A method according to claim 10, wherein a weft thread is laid on the sheet material prior to the formation of a stitch and wherein the weft thread is substantially obscured by the tubular rib after formation of the stitch.

12. A method according to claim 1, in which the composite sheet material including the longitudinal rows of stitches is subsequently stretched longitudinally.

13. A method of producing composite sheet material in which longitudinally rows of stitches are formed in a sheet material by needles which are advanced and retracted during the formation of each stitch comprising the steps of creating slack sheet material in the region of the needles, moving the needles during a first stage of the advance thereof to take up a least a part of the slack in the sheet material without piercing the sheet material, subsequently causing the needles to pierce the sheet material in a second stage of the advance of the needles and thereafter retracting the needles to form the stitches and thereby entrap within each stitch in each longitudinal row of stitches formed in the sheet material a portion of sheet material having a length greater than the length of the completed stitch.

14. A method according to claim 13, in which the longitudinal rows of stitches are formed through a plurality of sheets of sheet material fed simultaneously to a stitching machine, and the lengths of all sheet materials used per stitch are increased such that length of all sheet materials greater than the length of the completed stitch are entrapped within each stitch.

15. A method according to claim 13, in which the longitudinal rows of stitches are formed through a plurality of sheets of sheet material fed simultaneously to a stitching machine, and the length of sheet material used per stitch is increased for one of the sheet materials only.

16. A method according to claim 13, in which the sheet material is a plain paper sheet material.

17. A method according to claim 13, wherein the sheet material is a crepe paper sheet material.

18. A method according to claim 13, wherein the rows of stitches are formed through two sheets of different sheet materials, one sheet material being a plain paper sheet material and the other being a crepe paper sheet material.

19. A method according to claim 13, wherein the rows of stitches are formed through two sheets of plain paper sheet material.

20. A method according to claim 13, wherein the rows of stitches are formed through two sheets of crepe paper sheet material.

21. A method according to claim 13, wherein the rows of stitches are formed through two sheets of sheet material and wherein weft threads are laid between the sheets of sheet material prior to stitching by the stitching machine.

22. A method according to claim 13, in which the portion of sheet material entrapped within each stitch forms a tubular rib extending across the width of the composite sheet material.

23. A method according to claim 22, wherein a weft thread is laid on the sheet material prior to the formation of a stitch and wherein the weft thread is substantially obscured by the tubular rib after formation of the stitch.

24. A method according to claim 13, in which the composite sheet material including the longitudinal rows of stitches is subsequently stretched longitudinally.

* * * * *